US006612236B2

(12) United States Patent
Frankenberger et al.

(10) Patent No.: US 6,612,236 B2
(45) Date of Patent: Sep. 2, 2003

(54) SHEET TRANSPORT CYLINDER

(75) Inventors: Eckart Frankenberger, Darmstadt (DE); Michael Gieser, Oftersheim (DE); Peter Hachmann, Dossenheim (DE); Karl-Heinz Helmstädter, Heidelberg (DE); Christian Hieb, Neuhofen (DE); Ruben Schmitt, Heidelberg (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/944,566

(22) Filed: Aug. 31, 2001

(65) Prior Publication Data

US 2002/0046667 A1 Apr. 25, 2002

(30) Foreign Application Priority Data

Aug. 31, 2000 (DE) ..... 100 42 885

(51) Int. Cl.[7] ..... B41F 21/00; B65H 5/06
(52) U.S. Cl. ..... 101/232; 271/276
(58) Field of Search ..... 101/232; 271/276; 138/37, 40, 42, 44

(56) References Cited

U.S. PATENT DOCUMENTS

| | | | | | |
|---|---|---|---|---|---|
| 2,753,181 | A | * | 7/1956 | Anander | 226/95 |
| 3,823,743 | A | * | 7/1974 | King | 138/42 |
| 4,043,360 | A | * | 8/1977 | Yaron | 138/42 |
| 4,411,292 | A | * | 10/1983 | Schiller | 138/42 |
| 5,327,941 | A | * | 7/1994 | Bitsakis et al. | 138/42 |
| 5,542,659 | A | | 8/1996 | Haupenthal | |
| 5,913,268 | A | * | 6/1999 | Jackson et al. | 101/420 |
| 6,038,976 | A | | 3/2000 | Helmstädter et al. | |
| 6,270,074 | B1 | * | 8/2001 | Rasmussen et al. | 271/276 |
| 6,371,430 | B1 | * | 4/2002 | Vernackt | 248/362 |
| 6,460,991 | B1 | * | 10/2002 | Temple et al. | 347/104 |

FOREIGN PATENT DOCUMENTS

| | | |
|---|---|---|
| DE | 28 28 318 A1 | 1/1980 |
| DE | 43 15 527 A1 | 11/1994 |
| DE | 198 54 844 A1 | 7/1999 |
| DE | 199 05 095 C2 | 2/2001 |

* cited by examiner

*Primary Examiner*—Stephen R. Funk
*Assistant Examiner*—Leo T. Hinze
(74) *Attorney, Agent, or Firm*—Laurence A. Greenberg; Werner H. Stemer; Gregory L. Mayback

(57) ABSTRACT

A sheet transport cylinder in a machine that processes sheets of printing material includes air nozzles for sheet formats of the printing-material sheets. The printing-material sheets are dimensioned from a minimum format up to a maximum format. The sheet transport cylinder is distinguished by the fact that the air nozzles are throttled air nozzles disposed to be matched to the minimum format.

13 Claims, 6 Drawing Sheets

SHEET TRANSPORT CYLINDER

BACKGROUND OF THE INVENTION

Field of the Invention

The invention relates to a sheet transport cylinder in a machine that processes sheets of printing material. The sheet transport cylinder has air nozzles for sheet formats of the printing-material sheets that are dimensioned from a minimum format up to a maximum format, according to the preamble of claim 1.

German Published, Non-Prosecuted Patent Application DE 43 15 527 A1, corresponding to U.S. Pat. No. 5,542,659 to Haupenthal, includes a description of a sheet transport cylinder whose air nozzles are assigned a multi-way shut-off slide for adapting the format. The slide is capable of being operated manually or of being coupled to a drive device that is driven by a central machine control system.

The drawback with the prior art device is the expenditure of time that is needed in changing the format and that, in the case of manual operation, is needed for changing the format and, in the case of being driven by the machine control system, is needed for monitoring the changing of the format.

SUMMARY OF THE INVENTION

It is accordingly an object of the invention to provide a sheet transport cylinder that overcomes the hereinafore-mentioned disadvantages of the heretofore-known devices of this general type and that provides a sheet transport cylinder with a less complicated format changeover.

With the foregoing and other objects in view, in a machine processing sheets of printing material having various sheet formats, there is provided, in accordance with the invention, a sheet transport cylinder includes throttled air nozzles for affecting printing-material sheets having various size sheet formats. The sheet formats are dimensioned from a minimum format to a maximum format. The throttled air nozzles are disposed to match the minimum format.

Throttled air nozzles are surrounded by the air nozzles and are disposed such that they are matched to the minimum format. Therefore, all or at least some of the air nozzles of the sheet transport cylinder are throttled. In other words, some of the air nozzles of the sheet transport cylinder are throttled and some are unthrottled.

One advantage of the sheet transport cylinder according to the invention is that when the cylinder is being changed over to smaller sheet formats, no air shut-off measures relating to the volume of flow through the throttled air nozzles are needed, because of the low volume flow.

In accordance with another feature of the invention, there are provided air nozzles in addition to the throttled air nozzles. The air nozzles include unthrottled air nozzles.

In accordance with a further feature of the invention, the throttled air nozzles are disposed at points on a peripheral surface of the sheet transport cylinder that are not covered by the minimum format. The throttled air nozzles are, therefore, disposed downstream of a trailing edge and/or beside a side edge of the minimum format transported by the sheet transport cylinder.

In accordance with an added feature of the invention, only throttled air nozzles, and no unthrottled air nozzles, are located outside a region of the peripheral surface of the sheet transport cylinder that is covered by the minimum format. If the throttled air nozzles are suction nozzles, the embodiment minimizes the extraneous air stream flowing in through the uncovered, throttled air nozzles into an air line system belonging to the sheet transport cylinder, so that the vacuum prevailing in the air line system remains substantially functionally unimpaired. If, however, the throttled nozzles of the embodiment are blown air nozzles, then an extraneous air stream flowing out of the air line system through the uncovered, unthrottled nozzles is minimized. Accordingly, the consumption of energy required to generate the blown air, and the noise nuisance caused by the extraneous air, are reduced.

In accordance with an additional feature of the invention, the unthrottled air nozzles are covered by the minimum format. For example, within the area of the peripheral surface that is covered by the minimum format, only unthrottled air nozzles and no throttled air nozzles can be disposed. However, both throttled air nozzles and unthrottled air nozzles can be disposed within the area of the peripheral surface.

In accordance with yet another feature of the invention, the unthrottled air nozzles are disposed within the peripheral surface area.

In accordance with yet a further feature of the invention, an air throttle is associated with at least one of the throttled air nozzles.

In accordance with yet an added feature of the invention, each of the throttled air nozzles is connected to an air pressure generator through an air throttle. The air throttle can be integrated into the air line system remotely from the respectively throttled air nozzle. The configuration is beneficial if an air throttle is provided that, through the air line system, is simultaneously pneumatically connected to a plurality of throttled air nozzles. The air throttle and the air nozzle throttled by the air throttle can also form one structural unit in the form of a throttled nozzle. In such a case, each of the throttled air nozzles (throttled nozzles) is associated with its own air throttle disposed in the air nozzle (throttled nozzle).

In accordance with yet an additional feature of the invention, a bulk filling column is located in the air throttle as its constituent part, its small bulk elements forming flow resistances for the suction or blown air flowing through the air throttle and generated by the air pressure generator.

In accordance with again another feature of the invention, a throttling piece like an air filter is located in the air throttle as a constituent part and forms a flow resistance for the suction or blown air. For example, the throttling piece is a textile layer that may be woven or non-woven. However, the throttling piece can also be a porous and, therefore, air-permeable sponge, which has been foamed from a plastic.

In accordance with again a further feature of the invention, the air throttle is a spiral air duct.

In accordance with again an added feature of the invention, the air throttle is occupied by air baffles that project into the flow path of the suction or blown air and bound eddy chambers disposed between the projecting air baffles.

In accordance with again an additional feature of the invention, the air throttle is a perforated plate labyrinth.

In accordance with still another feature of the invention, the air throttle includes perforated plates disposed one above another and eddy chambers disposed between the perforated plates.

In accordance with still a further feature of the invention, the throttled air nozzles are suction nozzles.

In accordance with still an added feature of the invention, the throttled air nozzles are blowing nozzles.

With the objects of the invention in view, there is also provided a sheet-fed rotary printing machine processing printing-material sheets including at least one sheet transport cylinder having throttled air nozzles for affecting printing-material sheets having various size sheet formats, the sheet formats dimensioned from a minimum format to a maximum format, the throttled air nozzles disposed to match the minimum format.

Other features that are considered as characteristic for the invention are set forth in the appended claims.

Although the invention is illustrated and described herein as embodied in a sheet transport cylinder, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
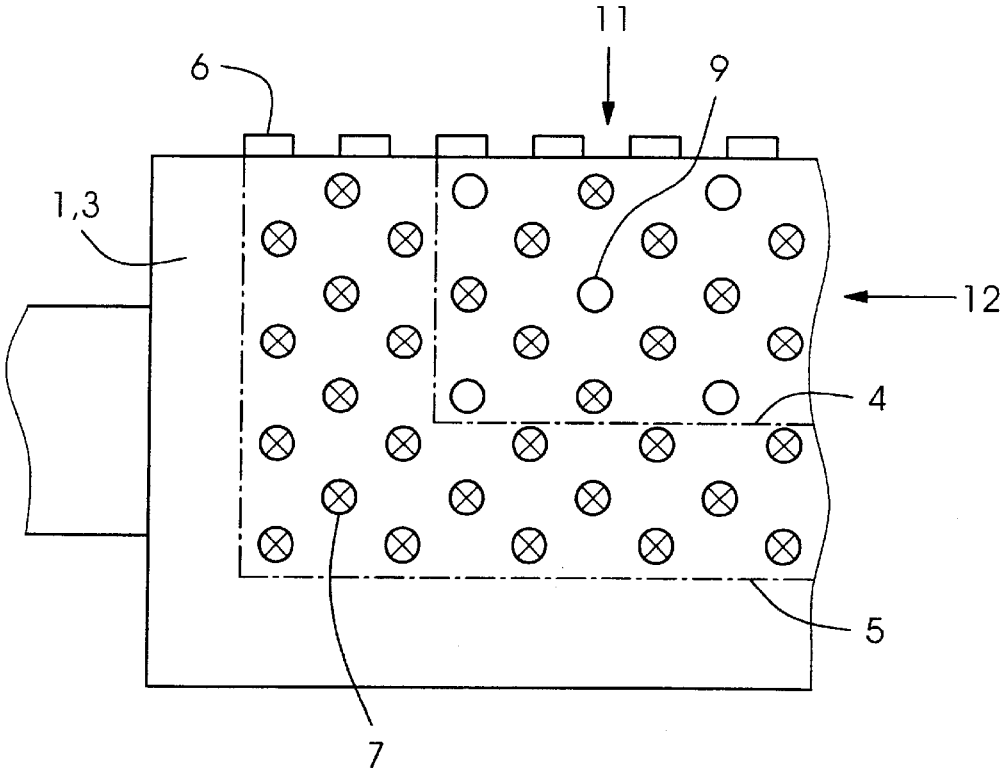
FIG. 1 is a fragmentary, elevational view of a first sheet transport cylinder according to the invention.

In all the figures of the drawing, sub-features and integral parts that correspond to one another bear the same reference symbol in each case. Related applications having the Application Serial Nos. (Attorney Docket Nos. A-2904, A-2905, and A-2936) are hereby incorporated herein by reference.

Figure 2:
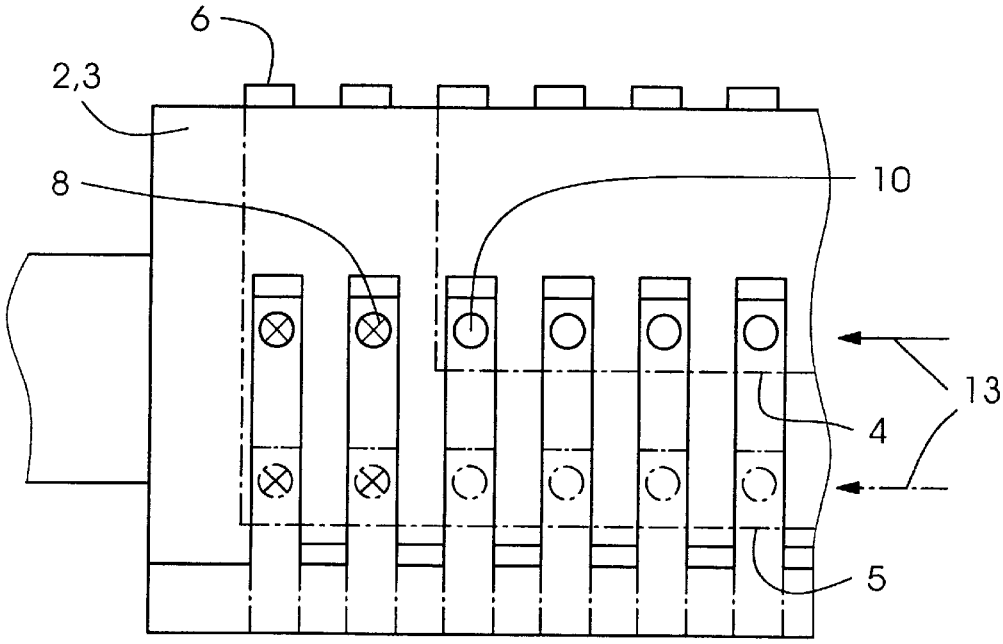
FIG. 2 a fragmentary, elevational view of a second sheet transport cylinder according to the invention.

Referring now to the figures of the drawings in detail and first, particularly to FIGS. 1 and 2 thereof, there is shown sheet transport cylinders 1 and 2 in a machine that processes sheets of printing material, in particular, a sheet-fed rotary printing machine 3. Reference numeral 4 designates a minimum format and reference numeral 5 designates a maximum format of the printing-material sheets transported on the sheet transport cylinder 1, 2. To hold the sheets firmly, each of the sheet transport cylinders 1, 2 has a gripper bar 6. Incorporated in the peripheral surfaces of the sheet transport cylinders 1, 2 are throttled air nozzles 7, 8 that are marked with crosses in FIGS. 1 and 2, and unthrottled air nozzles 9, 10.

In the case of the sheet transport cylinder 1 (cf. FIG. 1), the air nozzles 7, 9 are disposed in peripheral rows extending in the direction of the format length of the printing-material sheet, and in transverse rows extending in the direction of the format width in a nozzle grid. All the air nozzles in the nozzle grid located outside an area of the peripheral surface that is covered by the minimum format 4 are throttled. Within the covered area of the peripheral surface, both throttled air nozzles and unthrottled air nozzles are present. Within the covered area of the peripheral surface, the peripheral row 11 has alternating throttled and unthrottled air nozzles, such that the throttled air nozzles match the minimum format. The alternating nozzle configuration is also provided in the transverse row 12. All the air nozzles 7, 9 belonging to the sheet transport cylinder 1 are blowing nozzles. Configuring these air nozzles 7, 9 as suction nozzles is also conceivable.

In the case of the sheet transport cylinder 2 (cf. FIG. 2), the air nozzles 8, 10 are configured as suction nozzles and are disposed in a transverse row 13 parallel to the axis of the sheet transport cylinder 2, the row being mounted such that it can be displaced continuously in the peripheral direction of the sheet transport cylinder 2 from a first position into a second position and back again. In the first position of the transverse row 13, the air nozzles 8, 10 of the row 13 are close to a trailing edge of the minimum format 4 and under the latter. In the second Position of the transverse row 13, indicated as a phantom image, the air nozzles 8, 10 of the row 13 are located close to a trailing edge of the maximum format 5 and under the latter. All the air nozzles belonging to the transverse row 13 and located outside an area covered by the minimum format 4 are throttled, such that they are disposed to match the minimum format, and all the air nozzles belonging to the transverse row 13 and located within the area covered by the minimum format 4 are unthrottled. In FIG. 2, as well, the throttled air nozzles, for example, air nozzle 8, are marked with a cross and the unthrottled air nozzles, for example, air nozzle 10, have no such marking.

Figure 3:
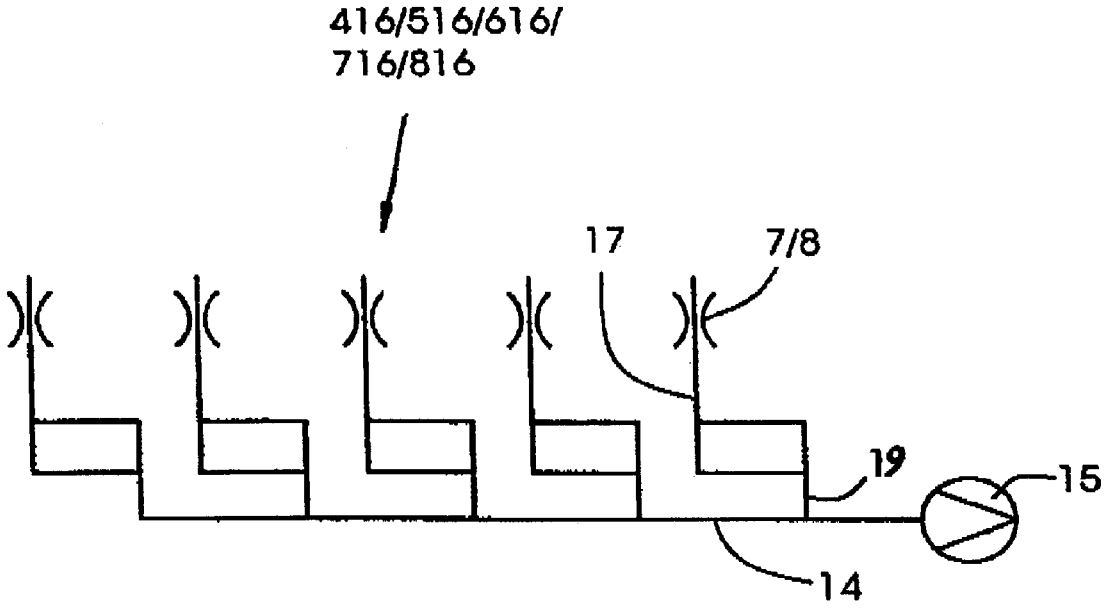
FIG. 3 is a schematic diagram of an air line system associated with the sheet transport cylinders of FIG. 1 or 2 and having throttled air nozzles and air throttles according to the invention.

FIG. 3 shows the connection of a plurality of throttled air nozzles belonging to the sheet transport cylinder 1 or 2 through an air line system 14 to a motor-driven air pressure generator 15, for example, a fan. If the connected air nozzles are blown air nozzles belonging to the sheet transport cylinder 1, such as the air nozzle 7, the air pressure generator 15 is an overpressure generator. If the connected air nozzles are suction nozzles belonging to the sheet transport cylinder 2, such as the air nozzle 8, the air pressure generator 15 is a vacuum generator, as indicated symbolically in FIG. 3.

Associated with each of the throttled air nozzles connected to the air pressure generator 15 is an air throttle 416, 516, 616, 716, 816 that can be disposed in the respectively throttled air nozzles 7, 8 or, as is shown, in the air line system 14. The air throttle 416, 516, 616, 716 has a throttle inlet 17 in a throttle cover 18 and a throttle outlet 19 in a throttle base 20. See FIG. 4.

The above allocation of the reference symbols 17 and 19 relates to a case in which the air throttles 416, 516, 616, 716, 816 have suction air flowing through them from the air nozzle 7. In the opposite case, when the air throttle 416, 516, 616, 716, 816 has blown air flowing therethrough, led toward the air nozzle 8, a mutually interchanged allocation of the reference symbols 17 and 19 applies.

The throttle cover 18 and throttle base 20 form the upper and lower boundary of a throttle chamber 21 that is disposed therebetween and through which the suction or blown air from the air pressure generator 15 flows.

For the configuration of the air throttles 416, 516, 616, 716, 816, there are various variants, examples of which are shown in FIGS. 4 to 8 and are described below.

In the air throttle 416 (cf. FIG. 4), there is a bulk filling 22 of small bulk elements, such as granules, fibers, chips, or small balls. The bulk filling 22 is held together by a net or grid 23 on both sides in the throttle chamber 21 in the air flow path between the throttle inlets 17 and the throttle outlets 19. The small bulk elements can also be sintered to one another for stability. Between the small bulk elements, the bulk filling 22 has intercommunicating cavities, through which the suction or blown air flows. The bulk filling 22 fills the cross-section of the throttle chamber 21 completely, so that the entire suction or blown air must flow through the bulk filling 22 and, in the bulk filling 22, is throttled by backing up on the small bulk elements and by eddies in the cavities.

Figure 4:
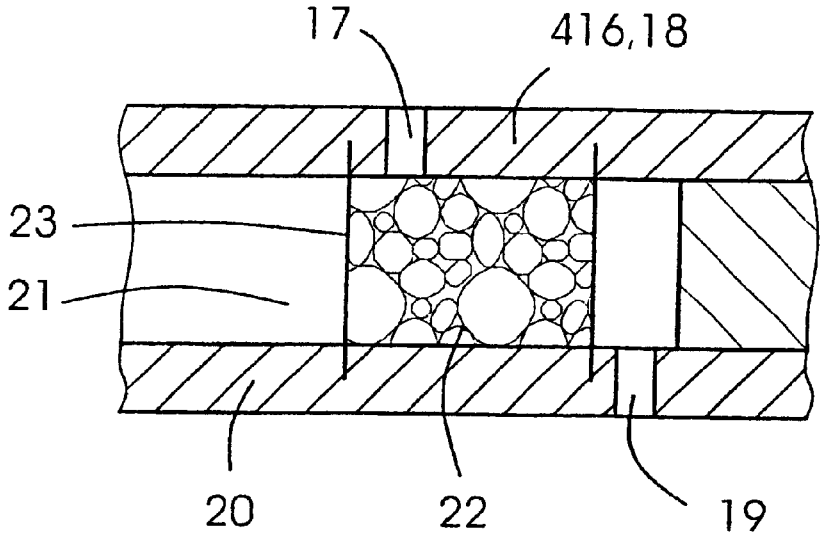
FIG. 4 is a fragmentary, cross-sectional view of an embodiment of an air throttle according to FIG. 3.

The components marked in FIG. 4 with the reference symbols 17 to 21 explained in detail will also be found again in the variants of the air throttle 516, 616, 716, and 816 illustrated in FIGS. 5 to 8, so that, in FIGS. 5 to 8, the reuse of the reference symbols 17 to 21 is possible without their renewed explanation.

Figure 5:
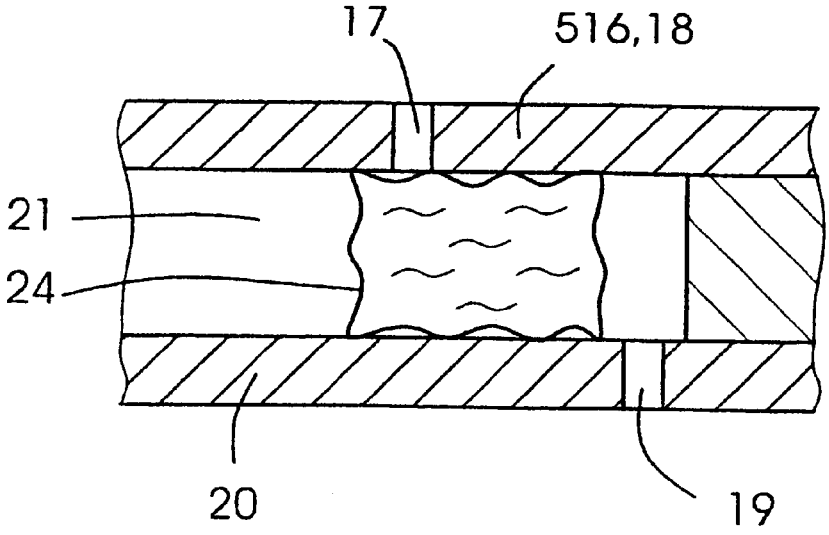
FIG. 5 is a fragmentary, cross-sectional view of a second embodiment of an air throttle according to FIG. 3.

In the variant of the air throttle 516 shown in FIG. 5, the bulk filling 22 is replaced by a textile throttling piece 24, such as a fabric or a non-woven, inserted into the throttle chamber 21. To fill the throttle chamber 21 from the throttle base 20 to the throttle cover 18 with the throttling piece 24, the throttling piece 24 may be made of a single, adequately voluminous layer, or can be wound up to form a multi-layer insert, or can be spread out in the throttle chamber 21. The suction or blown air flowing through the throttling piece 24 is throttled by backing up at threads or fibers and by eddies in the pores of the throttling piece 24.

Figure 6A:
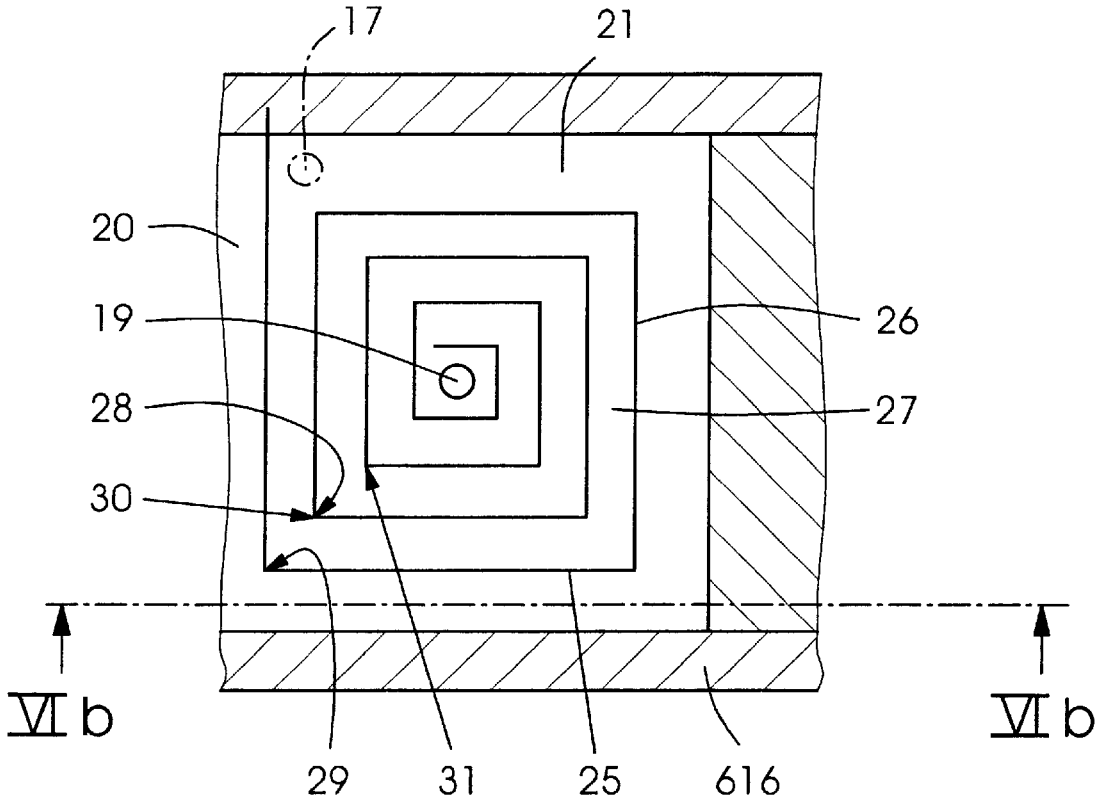
FIG. 6*a* is a fragmentary, cross-sectional plan view of a third embodiment of an air throttle according to FIG. 3.
Figure 6B:
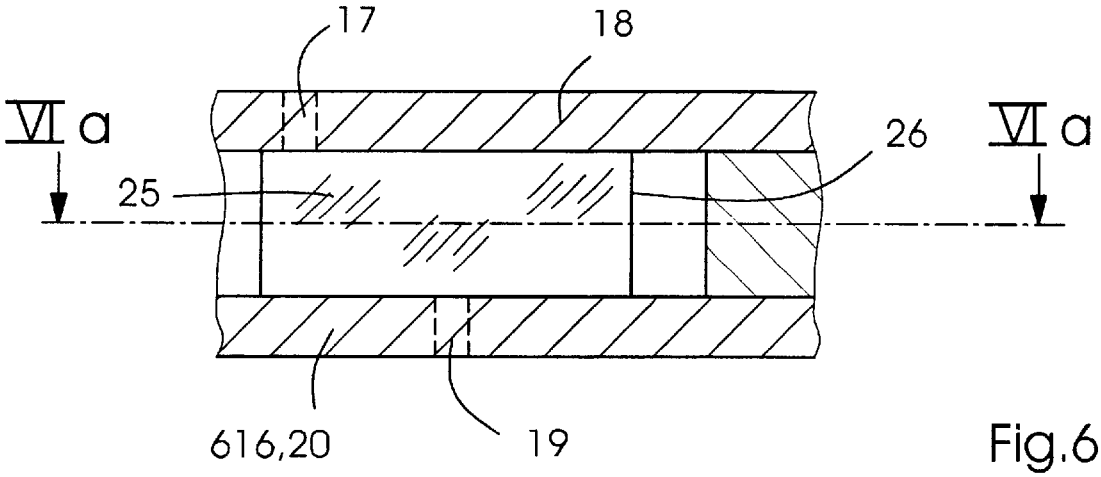
FIG. 6*b* is a fragmentary, cross-sectional side view of the air throttle according to FIG. 6*a;*

In FIG. 6*a* (a horizontal cross-section along the section line VIa—VIa in FIG. 6*b*) and FIG. 6*b* (a vertical cross-section along the section line VIb—VIb in FIG. 6*a*), an air throttle 616 is shown whose air guide walls 25, 26 are disposed at angles to one another in the throttle chamber 21, in particular, orthogonally. As a result, an air duct 27 is formed in a polygonal spiral that leads the suction or blown air between the air guide walls 25, 26 from the throttle inlet 17 to the throttle outlet 19. The suction or blown air flowing through the air duct backs up at corner angles 28, 29 of the air duct 27 and eddies at corner edges 30, 31 of the air guide walls 25, 26, so that the air flow is throttled. The air guide walls 25, 26 have a very high surface roughness that, for example, is brought about by treating the air guide walls 25, 26 by sand blasting and that contributes to reducing the flow velocity of the suction or blown air in the air duct 27 by increasing friction.

Figure 7A:
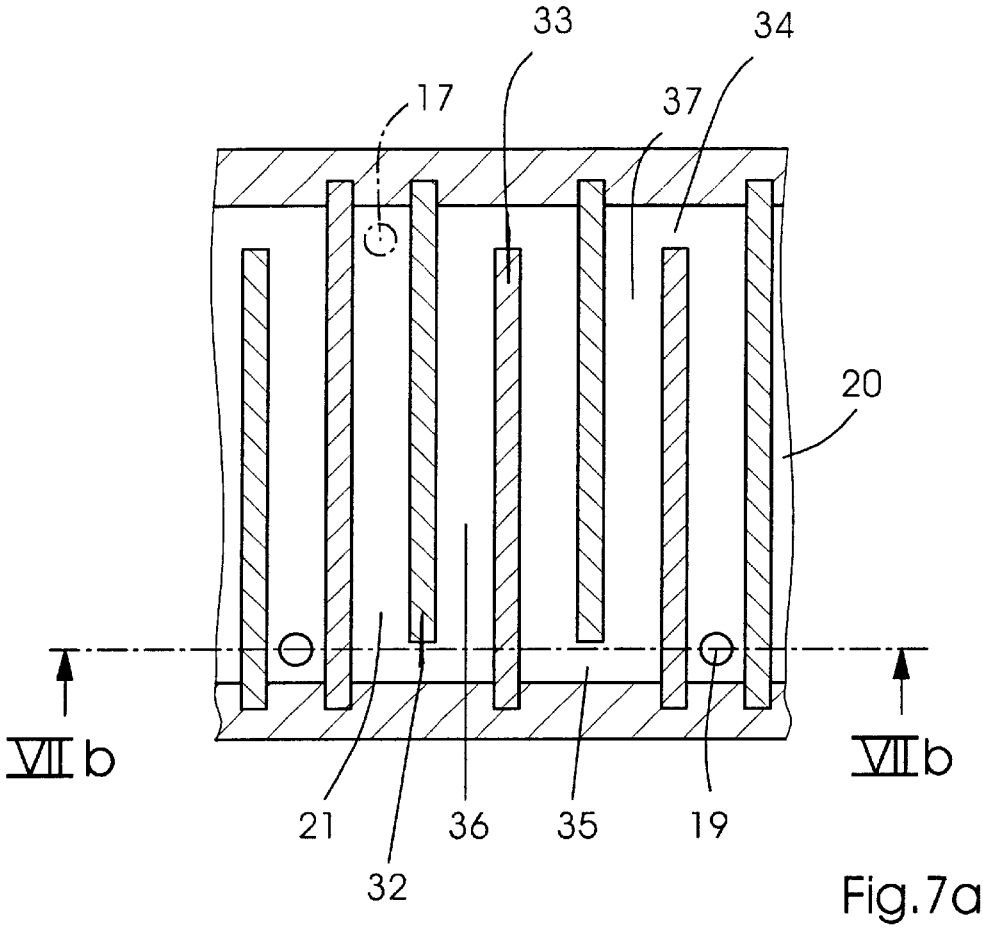
FIG. 7*a* is a fragmentary, cross-sectional plan view of a fourth embodiment of an air throttle according to FIG. 3.
Figure 7B:
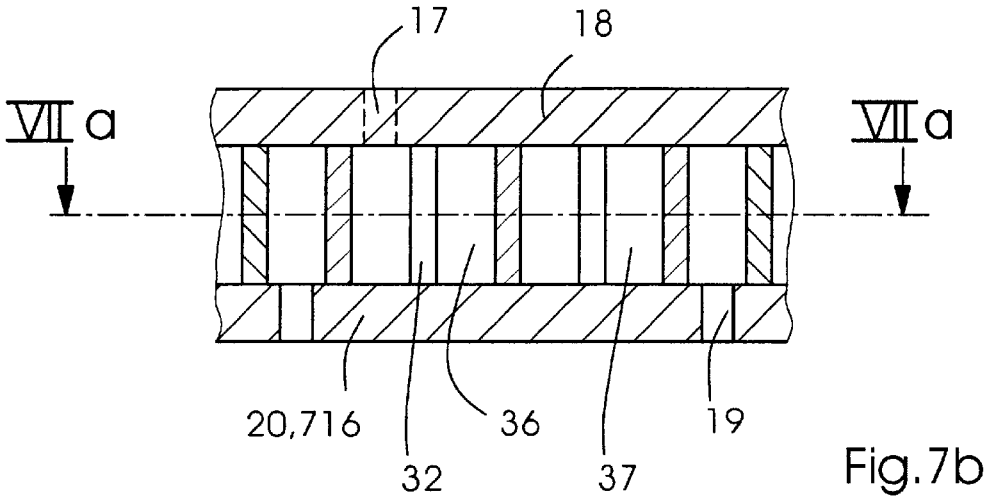
FIG. 7*b* is a fragmentary, cross-sectional view of the air throttle according to FIG. 7*a;*

In the case of the air throttle 716, shown in FIG. 7*a* as a horizontal cross-section and in FIG. 7*b* as a vertical cross-section, the throttle chamber 21 is fitted with air baffles 32, 33 in the form of baffle walls. The air baffles 32, 33 are disposed alternately in two rows and covering one another apart from narrow air gaps 34, 35. Between the air baffles 32, 33 there are eddy chambers 36, 37 that, together with the air gaps 34, 35, form a serpentine air duct that leads from the throttle inlet 17 to the throttle outlet 19 and in which the suction or blown air is throttled.

Also conceivable is a non-illustrated sandwich construction of the air throttle 716, in which the throttle cover 18 and the throttle base 19 are configured as lamella, between which there is an intermediate lamella, from which the serpentine air duct and the eddy chambers are cut out. Such an air throttle can be produced cheaply, for example, by stamping out the intermediate lamella, and, in a multiple configuration, can form a lamellar throttle pack.

Figure 8:
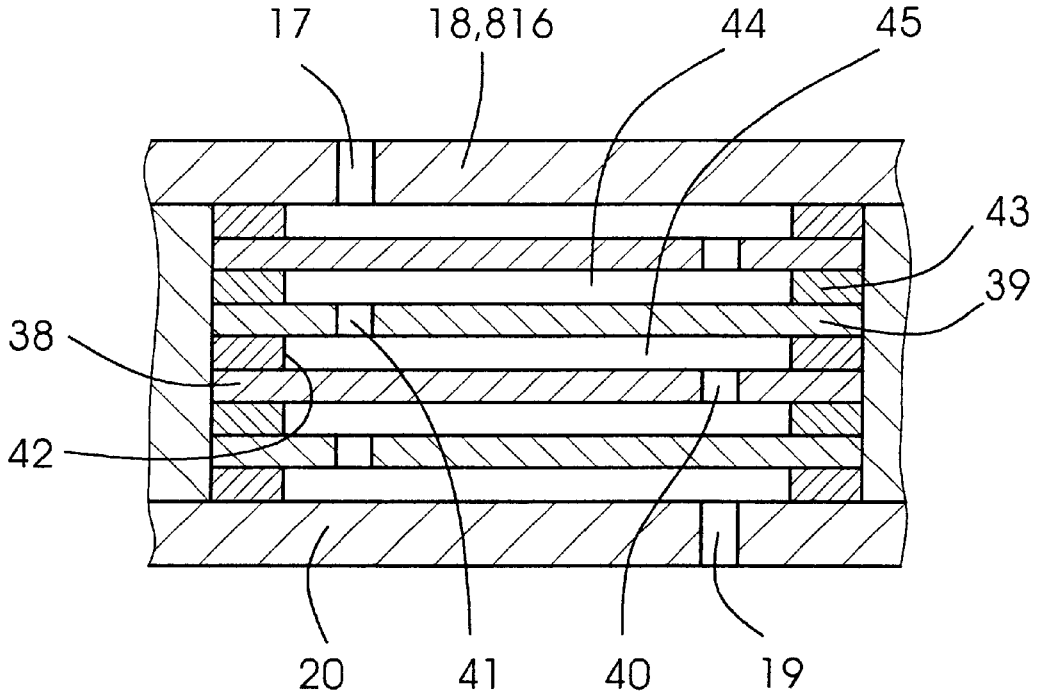
FIG. 8 is a fragmentary, cross-sectional view of a fifth embodiment of an air throttle according to FIG. 3.

FIG. 8 shows a cross-section through the air throttle 816 that includes perforated plates 38, 39 disposed one above another in the throttle chamber 21 in a sandwich construction. Each of the perforated plates 38, 39 has at least one hole 40, 41 that is disposed in the plane of the plate so as to be offset in relation to at least one hole 41, 40 in the respectively adjacent perforated plate. The holes 40, 41, forming a serpentine air duct, are, therefore, misaligned with respect to one another and overlap with closed plate areas of the perforated plates 38, 39. Spacers 42, 43 hold the perforated plates 38 and 39 at a distance from one another and determine volumes of eddy chambers 44, 45 that are located between the perforated plates 38, 39 and through which the suction or blown air blows. The air backs up upstream of the holes 40, 41 representing the narrow points in the flow path, and eddies in the eddy chambers 44, 45. The throttling action of the air throttle 816, just like the throttling action of the air throttles 616 and 716, is based on reducing the flow velocity of the suction or blown air by multiple deflection of the air flow in the throttle chamber 21.

Further advantages are described below.

The characteristics of the "attractive behavior" of a suction nozzle evacuated through the air throttle 416, 516, 616, 716, 816, for example, the air nozzle 8, is much better for many applications than the characteristics of conventional, that is to say unthrottled, Venturi nozzles. The throttled suction nozzle exerts a comparatively low attraction force on the printing-material sheets in the remote area, and a comparatively high attraction force in the near area, the suction force exerted on the printing-material sheets increasing disproportionately, in other words, more than linearly, in the direction of the near area. The suction nozzle fixes the printing-material sheet only when the sheet is sufficiently close to the suction nozzle, which is a desirable effect in many applications.

Likewise, in the case of a combination of the air throttle 416, 516, 616, 716, 816 with a blowing nozzle, for example, the air nozzle 7, the nozzle's "repulsive behavior" characteristics improve. The throttled blowing nozzle exerts a blowing force on the printing-material sheet that decrease disproportionately, that is to say, more than linearly, with increasing distance from the blowing nozzle. It is, therefore, possible, between a nozzle surface provided with the throttled blowing nozzle (i.e., the peripheral surface of the sheet transport cylinder 1) and the printing-material sheet, to generate an air cushion that is much thinner, as desired in many applications, but, nevertheless, keeps the printing-material sheet at a safe distance from the nozzle surface, than that made possible with conventional, that is to say, unthrottled, blowing nozzles.

We claim:

1. In a machine processing printing-material sheets having various sheet formats dimensioned from a minimum format to a maximum format, a sheet transport cylinder, comprising;

a peripheral surface area dimensionally corresponding to the minimum format;

unthrottled air nozzles;

throttled air nozzles for affecting the printing-material sheets, said throttled air nozzles disposed to match the minimum format and at least some of said throttled air nozzles disposed outside said peripheral surface area.

2. The sheet transport cylinder according to claim 1, wherein only said throttled air nozzles are disposed outside said peripheral surface area.

3. The sheet transport cylinder according to claim 2, wherein said unthrottled air nozzles are disposed within said peripheral surface area.

4. The sheet transport cylinder according to claim 1, wherein said unthrottled air nozzles are disposed within said peripheral surface area.

5. The sheet transport cylinder according to claim 1, including an air throttle associated with at least one of said throttled air nozzles.

6. The sheet transport cylinder according to claim 5, wherein said air throttle is a bulk filling.

7. The sheet transport cylinder according to claim 5, wherein said air throttle is a textile throttling piece.

8. The sheet transport cylinder according to claim 5, wherein said air throttle is a spiral air duct.

9. The sheet transport cylinder according to claim 5, wherein said air throttle includes projecting air baffles and eddy chambers disposed between said projecting air baffles.

10. The sheet transport cylinder according to claim 5, wherein said air throttle includes perforated plates disposed one above another and eddy chambers disposed between said perforated plates.

11. The sheet transport cylinder according to claim 1, wherein said throttled air nozzles are suction nozzles.

12. The sheet transport cylinder according to claim 1, wherein said throttled air nozzles are blowing nozzles.

13. A sheet-fed rotary printing machine processing printing-material sheets having various sheet formats dimensioned from a minimum format to a maximum format, the printing machine comprising:

at least one sheet transport cylinder having a peripheral surface area dimensionally corresponding to the minimum format;

said at least one sheet transport cylinder having unthrottled air nozzles and throttled air nozzles for affecting the printing-material sheets;

said throttled air nozzles disposed to match the minimum format and at least some of said throttled air nozzles disposed outside said peripheral surface area.

* * * * *